US007222578B2

(12) United States Patent
Kaneko

(10) Patent No.: US 7,222,578 B2
(45) Date of Patent: May 29, 2007

(54) APPARATUS FOR REMOVING ATTACHMENTS DEPOSITED ON UNDERWATER STRUCTURE

(75) Inventor: Shuichi Kaneko, Hokkaido (JP)

(73) Assignee: Ecoguard Systems Ltd., Hokkaido (JP)

( * ) Notice: Subject to any disclaimer, the term of this patent is extended or adjusted under 35 U.S.C. 154(b) by 0 days.

(21) Appl. No.: 11/238,612

(22) Filed: Sep. 29, 2005

(65) Prior Publication Data

US 2006/0143846 A1 Jul. 6, 2006

(30) Foreign Application Priority Data

Oct. 1, 2004 (JP) ..... 2004-289556

(51) Int. Cl.
*B63B 59/00* (2006.01)

(52) U.S. Cl. ..... 114/222

(58) Field of Classification Search ..... 114/222; 405/222

See application file for complete search history.

(56) References Cited

U.S. PATENT DOCUMENTS 5,040,923 A * 8/1991 Do ..... 405/211

FOREIGN PATENT DOCUMENTS

| | | |
|---|---|---|
| JP | 10/219652 | 8/1998 |
| JP | 11-043095 | 2/1999 |
| JP | 2000-008339 | 1/2000 |
| JP | 2003-019998 | 1/2003 |
| JP | 2003-253643 | 9/2003 |

* cited by examiner

*Primary Examiner*—Stephen Avila
(74) *Attorney, Agent, or Firm*—Norris McLaughlin & Marcus PA

(57) ABSTRACT

An apparatus for removing attachments deposited on a surface of an underwater structure and preventing that such attachments be deposited thereafter. The apparatus is floated on the water surface or underwater and with the aid of a natural force repeatedly impinges upon the surface of the structure to remove attachments deposited thereon. The apparatus has a first rope being provided around the surface of the structure at the water surface level, and at least one or more rotating members threaded with said first rope and being freely rotatable about the rope. The rotating members impinge upon the surface of the structure when the apparatus floats on the water surface level or underwater shaving off attachments deposited on the structure, and preventing any further attachments from being deposited thereafter. It is preferred to provide some protruding portions on the surface area of the rotating members where the rotating members impinge upon the surface of the structure.

13 Claims, 5 Drawing Sheets

APPARATUS FOR REMOVING ATTACHMENTS DEPOSITED ON UNDERWATER STRUCTURE

BACKGROUND OF THE INVENTION

1. Field of the Invention

The present invention relates to an apparatus for removing attachments deposited on underwater structures; particularly, relating to an apparatus for removing marine organisms deposited on underwater structures, such as stanchions extending underwater, particularly in the sea, and for preventing possible deposits thereafter.

2. Prior Art Statements

As the prior art for removing marine organisms deposited on piles that support marine constructions, such an apparatus is known that is constituted of a metal wire with buoyant pieces that floats around piles on the surface of the sea where with the aid of wave power the wire makes contact with marine organisms in order for them to be removed. (See Japanese Patent Preliminarily Publication No. 10-219652)

Another apparatus is known which comprises a plurality of hollow bodies each respectively having lugs at both ends, a protective ring provided on each hollow body in a rotatable manner, and a socket ring further provided on the protective ring in a fixed manner. The hollow bodies each having a protection ring and a socket ring are connected together to make a large circle, and set out around structures, such as piles, so that the apparatus makes contact with the surface of the structures with the aid of wave force to remove attachments, such as marine organisms, deposited thereon (See Japanese Patent Preliminarily Publication Nos. 2000-8339 and 2003-1998). When the apparatus makes contact with the structures, the protective ring and the socket ring rotate in a united manner, so that the impact when the apparatus impinge upon the structures is absorbed and thus the wear of both the structures and the apparatus is decreased. At the same time, the apparatus shows excellent performance in removing the attachments deposited on underwater structures. In this manner, it is an elementary requirement that the part of the apparatus where contact is made with the structure is rotatable, in order to improve the durability and the deposit removing ability of the apparatus.

These conventional apparatuses for removing attachments deposited on structures are set out in the water such that the apparatus surrounds underwater structures, such as piles. The apparatus makes repeatedly contact with the surface of the structures; resulting in deposits, such as marine organisms, being removed in several weeks. By leaving the apparatus thereafter, further deposits of marine organisms on the surface of the structure can be prevented in the future.

The apparatus for removing deposits disclosed in Japanese Patent Preliminarily Publication No. 10-219652 is arranged such that a wire having some floating bodies makes contact with the surface of steel piles or concrete piles in order to remove the attachments deposited thereon. Since the apparatus is left for a comparatively long term, it is required to use metal wire, such as that made of stainless steel. However, galvanic corrosion occurs on such metal wire after setting it out underwater, and it therefore cannot stand long term use. Further, when the wire is partially damaged, for example, by corrosion, it is necessary to change the wire as a whole, requiring hefty work at great expense. Furthermore, the metal wire should be hard and thin which causes abrasion to the concrete piles over an extended period of time deteriorating the strength thereof.

In the apparatus for removing deposits disclosed in Japanese Patent Preliminarily Publication Nos. 2000-8339 and 2003-19998, the rotatable protection ring and the socket ring are provided on the outer surface of each hollow body to be connected together. These members, i.e. the protection ring, the socket ring and the hollow body, need to be separately prepared and then assembled. This makes the manufacturing cost of the apparatus high, and the assembly work complicated. When using the apparatus, plural members are connected together and it is necessary to prepare many of the apparatuses at a single site, therefore manufacturing costs increase and heavy assembly work is required. Since the apparatuses are connected together with the aid of nuts and bolts, and on average 15~40 apparatuses are used at a single site, a large amount of labor is required.

Further, as stated above, plane lugs are provided at both ends of the hollow body; and the bodies are connected together in such a manner that the lugs are superimposed on one another with the aid of nuts and bolts. However, in such a construction, when an outer force is applied to the superimposed lugs in a perpendicular direction, it is difficult to allow release of the outer force. This causes the problem of the apparatus becoming brittle in structure. Furthermore, a soft vinyl chloride is used for the material of the apparatus, causing a toxic gas to generate freely when the apparatus is incinerated for disposal.

SUMMARY OF THE INVENTION

In the light of these problems, the present invention has for its purpose to provide an apparatus for removing attachments deposited on underwater structures, according to which manufacturing and assembly of the apparatus can be easily carried out, no abrasion of the structures occurs after setting the apparatus on the structures; deposits can be removed in an effective manner; a high durability is given; and it is friendly to the environment.

The apparatus for removing attachments deposited on underwater structures according to the invention is set out around the structures so as to be on the surface or underwater, and the apparatus is naturally wafted on the surface of water or underwater where repeated contact occurs with the structures to remove the deposits thereon and to further prevent attachments such as marine organisms being deposited thereon in the future. The apparatus comprises a rope (first rope) arranged around or on the surface of said structures and at least one or more rotating members through which said rope extends so as to allow free rotation of the members about the rope.

The apparatus has an aspect that at least one part of said rotating member is hollow.

The apparatus has yet another aspect that the apparatus further comprises a second rope connected to said first rope and extended in a direction substantially perpendicular to the extended direction of said first rope, with at least one or more second rotating members having a breakthrough through which said second rope extends so as to freely rotate the second rotating members about the second rope underwater.

The apparatus has still another aspect that said second rotating member has a closed structure in which heavy material, such as sand or water, is contained; and/or has two or more openings through which water flows into the hollow portion when the rotating member is underwater.

The apparatus has still another aspect that said apparatus comprises a third rope being connected to the lower end of said second ropes and extended in a direction perpendicular to the extending direction of the second rope; and at least one second rotating member is threaded with the third rope through the breakthrough of the second rotating member.

In the apparatus for removing attachments deposited on underwater structures according to the invention, it is preferred that two or more rotating members are provided on the first to third ropes, and cylindrical collars each having an inner diameter sufficiently larger than the diameter of the ropes but smaller than the diameter of the rotating members be arranged around the ropes at each space between the adjacent rotating members.

Further, it is advantageous that said first or second rotating members have an ellipsoid or rugby ball shape, and have a breakthrough for inserting the relevant rope in its longitudinal direction.

Furthermore, it is advantageous that a protrusion is provided on at least one part of the rotating surface area of said rotating member.

It is further advantageous that said protrusion comprises a plurality of ridges which are evenly spaced apart and that extend in a direction perpendicular to the rotating direction of the rotating member, i.e. in the longitudinal direction of the rotating member.

Said rotating members are manufactured either by the process of blow-molding polyethylene resin or by fitting and/or welding a few molded polyethylene parts to complete the rotating member.

It is preferred that said ropes are prepared by twisting synthetic fibers made of polyethylene, etc.

It is also preferred that said first and/or third ropes have ring shape end portions, and that both ends of the ropes are connected together in such a manner that the end portions are superimposed together and then connected together with the aid of a bobbin-shaped connector, respectively.

According to the present invention, since a rope is used to connect the rotating members, no galvanic corrosion occurs as does with the conventional metal wire, so the durability of the apparatus is improved. Such a rope has the further advantage that underwater structures are not physically damaged, because the rope is softer than the metal wire. Furthermore, since a rope can be bent in all directions, outer forces exerted on the apparatus can be released in a suitable manner. Moreover, the apparatus is constructed such that each rotating member as a whole is rotatable about the rope, so the apparatus can be manufactured and assembled much more easily and simply in comparison to the conventional apparatus where a rotatable protection ring or a socket ring is separately provided on the outer side of the hollowed or solid body.

According to the invention, as long as at least one part of the rotating member is arranged to be hollowed, it is not necessary to provide any additional floats to the rotating members. Therefore, manufacturing and labor costs for assembly of the rotating member can be saved.

In another embodiment, at least one or more second ropes are connected to the first rope in a vertically extended manner and at least one or more rotating members (second rotating members) each having a breakthrough, through which the second rope passes, are arranged to be rotatable about the second rope underwater. That is to say, a plurality of the apparatuses are connected in a vertical direction, so that the attachments deposited on the piles extended in a vertical direction underwater can be removed on a large scale.

In this embodiment, the second rotating member may be arranged such that sand or water is enclosed inside of the rotating member, and/or two or more openings penetrate the rotating members so that water can flow through the hollow of the second rotating member. According to this construction, the buoyancy of the rotating members is lost making it possible for the rotating members to waft underwater. Therefore, attachments deposited underwater on the surface of the piles can be effectively removed and can be prevented from being deposited thereafter.

In still another embodiment, the apparatus further comprises a third rope that is connected to the lower ends of the second ropes extended in a direction almost parallel to the extended direction of the first rope, and with at least one second rotating member threaded by the third rope. In such a construction, the second ropes extend in an up/down direction in a stable manner. It can be expected to remove and prevent attachments with the rotating members rotating around the third rope, so that attachments deposited on the surface of underwater piles can be removed more efficiently.

It is preferred that collars are provided between the abutted rotating members, having an inner diameter sufficiently larger than the diameter of the ropes but smaller than the diameter of the rotating members. The collars impinge on the right and left side rotating members with the aid of natural forces, such as waves, so that the attachment of marine organisms onto the rotating members can be effectively prevented.

In the present invention, each rotating member has an ellipsoid shape (or a rugby ball shape) and a breakthrough is provided in its longitudinal direction for inserting the rope therethrough. Therefore, the attachments deposited on the edge portion of the rectangular shaped structure can be removed more efficiently in comparison to the use of round rotating members.

Further, a protruding portion is provided on at least one part of the area of the rotating member where the rotating member is apt to impinge against the structure. Thereby the edge of the protruding portion allows the effective shaving off of attachments while the durability of the apparatus is improved with the thickened part of the protruding portion.

Furthermore, by providing evenly spaced ridges on the protruding part that extend in a perpendicular direction to the rotating direction of the rotating member it is expected that attachments are shaved off more efficiently when the members rotate.

The rotating members can be manufactured by the process of blow-molding polyethylene resin; or by fitting and/or welding together the two or three parts that constitute the rotating member. According to this aspect, the rotating members can be manufactured and assembled easily, and it is possible to reduce the generation of toxic gas when incinerating the members for disposal. After use, the rotating members may also be re-cycled as a plastic material.

The ropes may be prepared by twisting a synthetic resin, such as polyethylene, so desired features, i.e. light weight, softness and strength can be attained. It should be noted that a polyethylene resin is easy to re-use and therefore, eco-friendly.

It is preferred that the ends of the first and third ropes have ring-shape portions, and that the ring-shaped ends are superimposed and held by means of a bobbin shaped fastening, so that a tight fastening can be realized for a long term and thus the durability of the apparatus is improved.

DETAILED DESCRIPTION OF THE PREFERRED EMBODIMENTS

Details of the embodiments of the apparatus for removing attachments deposited on underwater structures according to the present invention will be explained below.

Figure 1:
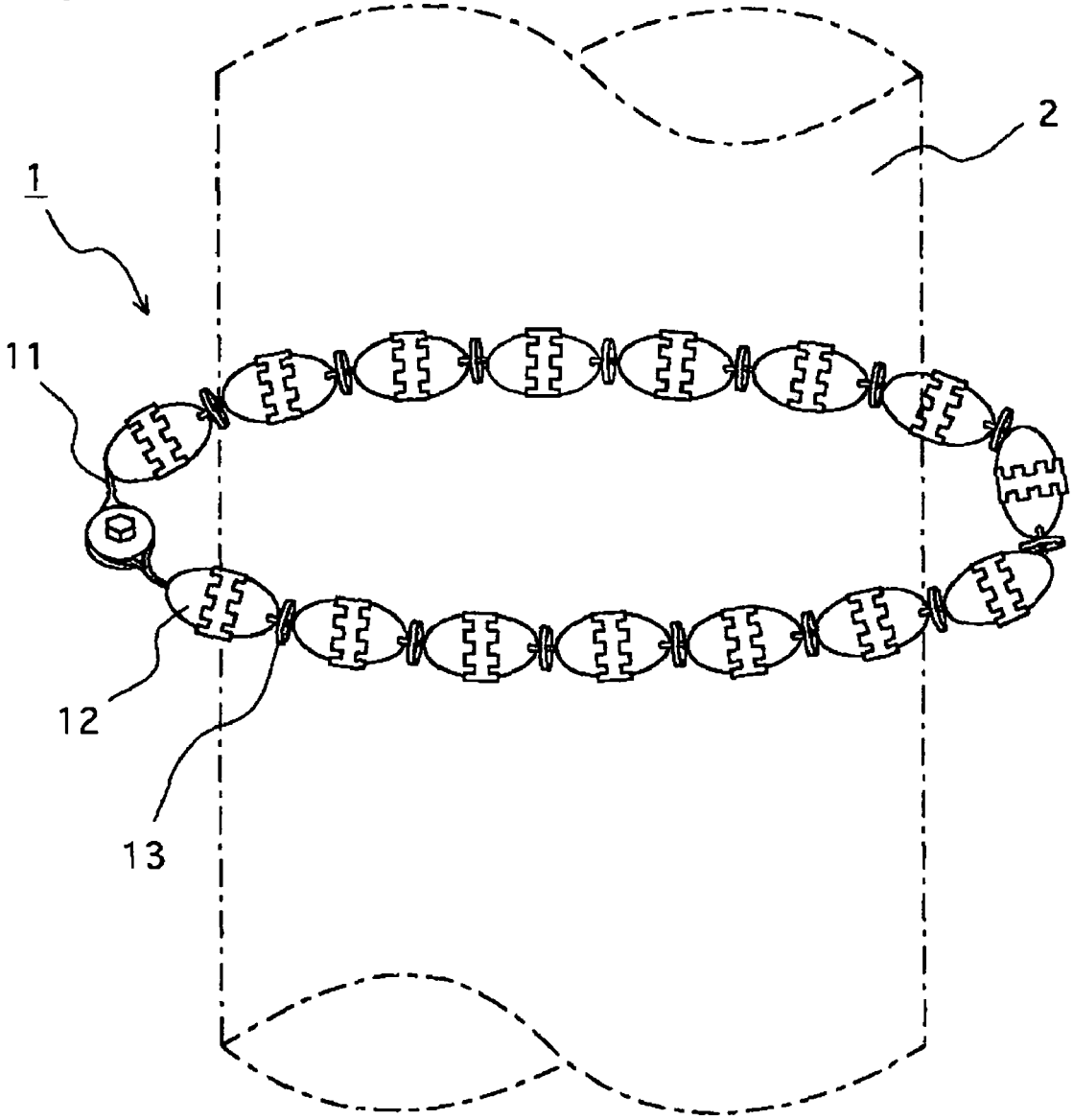
FIG. 1 is a perspective view showing a structure of an embodiment of the apparatus for removing attachments deposited on underwater structures according to the first embodiment of the present invention.

FIG. 1 is a schematic view showing the construction of the first embodiment of the apparatus for removing attachments deposited on underwater structures according to the invention. In FIG. 1, the apparatus 1 is provided around a constructional pile 2 (structure), which extends from the bottom of the sea, like a bridge pile. For explanation purposes, structure 2 is shown with a dotted line. The surface of the water is not shown in the figure, but it is assumed that the apparatus 1 is floating on the surface of the water.

As shown in FIG. 1, the apparatus 1 comprises a circular rope 11 being arranged so as to surround the outer surface of the structure 2 and a plurality of rotating members 12 which are arranged in such a manner that the rope 11 is inserted through the rotating members 12 in their longitudinal direction and then the rotating members 12 can be rotated about the rope 11. The rope 11 has a longer length than the outer circumference of the structure 2 so that the apparatus 1 can freely float around the structure 2 as the force of wind and/or waves, changes its shape. However, if the length of the circular rope 11 is too long, the apparatus will not impinge on the surface of the structure. Therefore, it is required to determine the length of the rope such that the rotating members can suitably impinge on the surface of the structure, such as, for example, that the diameter of the circular rope is greater than that of the structure by 50 cm. The number of rotating members to be provided is at least one or more, but preferably selected such that when the rotating members are threaded with the rope, each rotating member can be freely rotated about the rope and can be moved with sufficient play, i.e. 10 to 15 cm, in the extending direction of the rope 11. Between abutted rotating members 12, a cylindrical collar 13 is provided, which has an inner diameter sufficiently larger than the outer diameter of the rope 11 and smaller than the outer diameter of the rotating member 12. The collar 13 is made of a resin having elasticity, so that it works as a damper between the abutted rotating members 12, and the collars 13 themselves contribute to prevent marine organisms from attaching onto the surface of the rotating members.

Figure 2A:
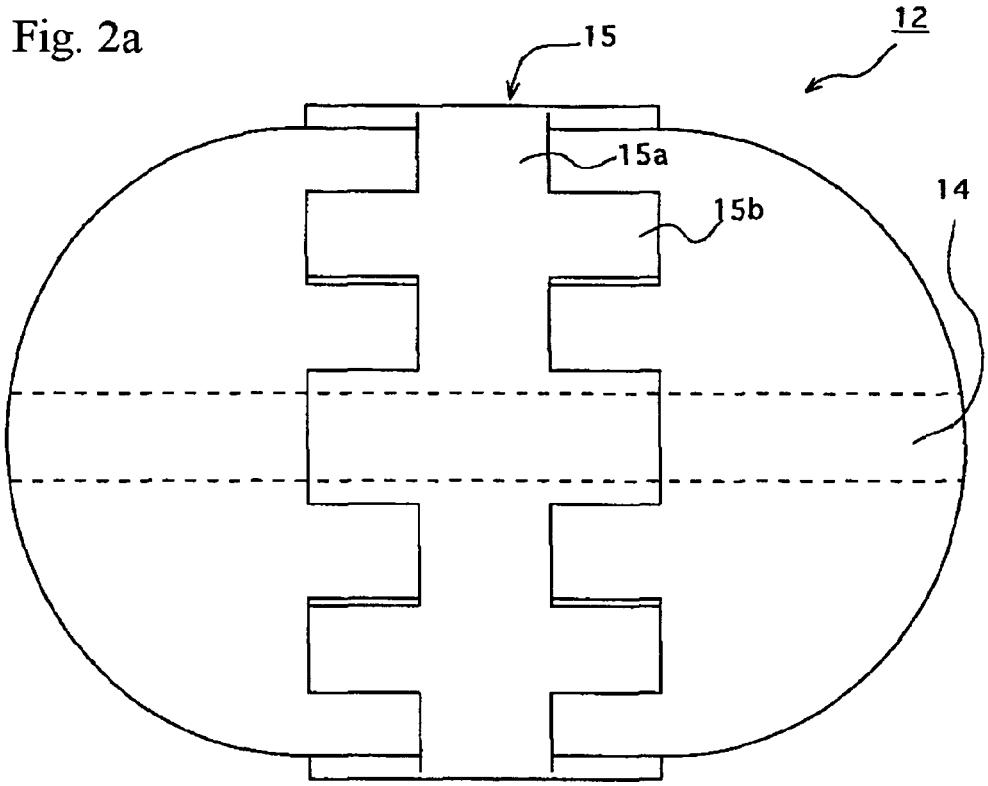
FIG. 2*a* is a side view depicting a construction of a rotating member 12 used for the apparatus according to the present invention.
Figure 2B:
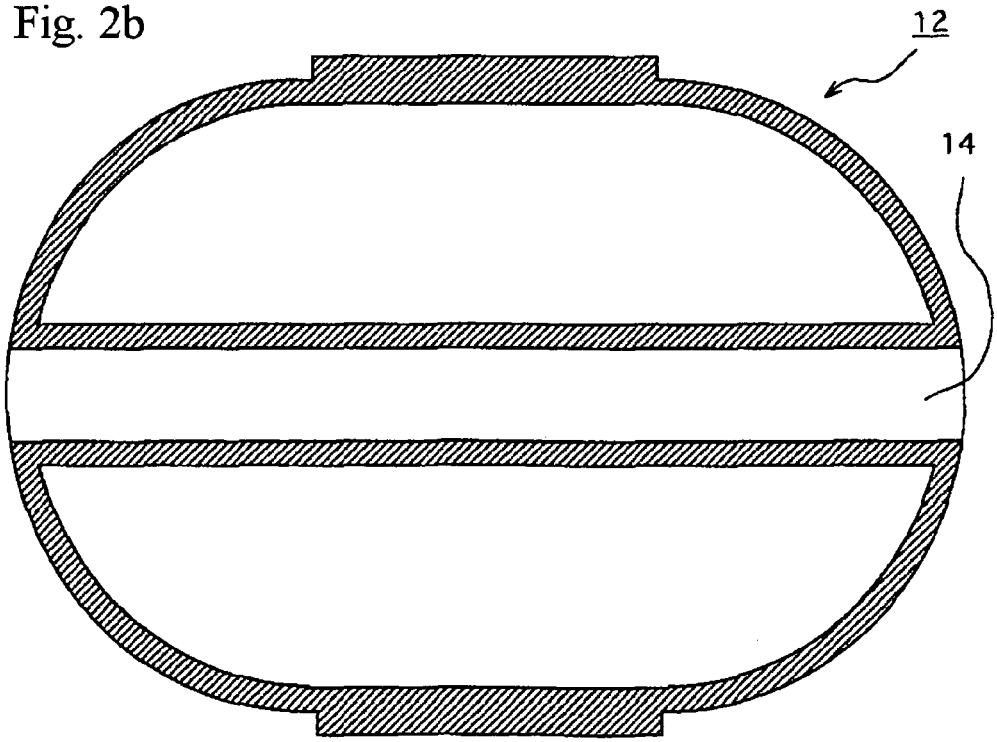
FIG. 2*b* is a cross sectional view illustrating a construction of a rotating member 12 used for the apparatus according to the present invention.

FIG. 2 is a schematic view illustrating the construction of the rotating member 12: FIG. 2*a* is a side view and FIG. 2*b* is a cross sectional view of the rotating member 12. As illustrated in FIGS. 2*a* and 2*b*, the rotating member 12 has an ellipsoid shape and has a breakthrough 14 in a longitudinal direction thereof, through which the rope 11 can be inserted. It should be noted that it is not necessary for the breakthrough 14 to be in the center of the rotating member, but it could be positioned eccentrically. The inner diameter of the breakthrough 14 should be larger than the outer diameter of the rope 11, so that the rotating member 12 can be freely rotated about the rope 11. The rotating member 12 of the present embodiment is made of a polyethylene resin and has a hollow structure with an outer wall thickness of 5 mm. Polyethylene resin can be suitably used for the material of the rotating members 12 because it has excellent resistance to low temperatures, resistance to impact, resistance to chemical attacks, and resistance to climate; it can be re-used as a plastic material after use; and further it generates no dioxins when incinerated for disposal. In this embodiment, the rotating member 12 has a length of 220 mm in its longitudinal direction and a diameter of 160 mm.

On the surface of the rotating member 12, a protruding portion 15 is formed, which is used for rubbing attachments, such as marine organisms, off from the surface of the structure 2 in an effective manner and for improving the durability of the rotating member 12. As shown in FIG. 2*a*, the protruding portion 15 comprises a center portion 15*a* extended onto the outer circumference of the structure 1 in its rotating direction and a plurality of ridges 15*b* extended in the longitudinal direction of the rotating member 12 with a certain space therebetween. The protruding portion 15 is formed on the rotating member 12 as a unit body and protrudes about 5 mm from the surface of the rotating member 12. The rotating member 12 has a partial thickness of 10 mm at the protruding portion 15, and will therefore not break, if worn somewhat by the impingement of attachments, such as marine organisms. The protruding portion 15 protrudes substantially perpendicularly from the surface of the rotating member 12, so that attachments on the structure 2 can be efficiently rubbed off by the rotation of the rotating members 12.

Figure 3A:
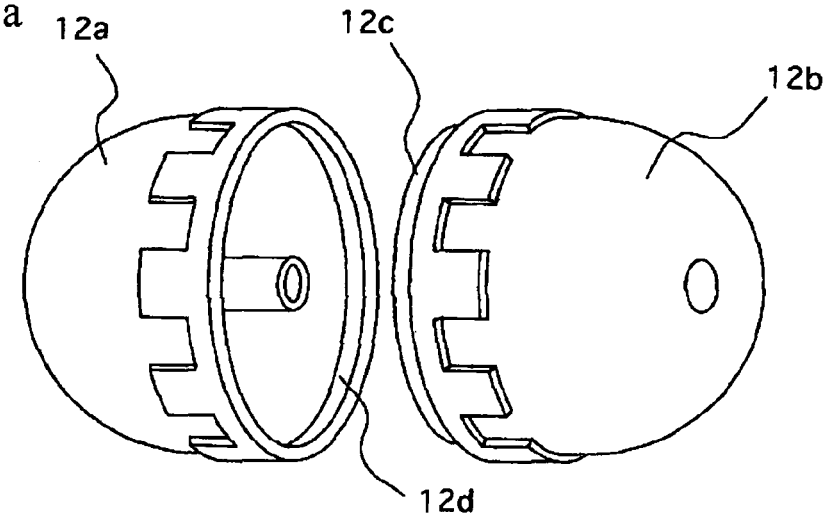
FIGS. 3*a* to 3*c* are perspective views representing variations of construction of the rotating member 12 used for the apparatus according to the present invention.
Figure 3B:
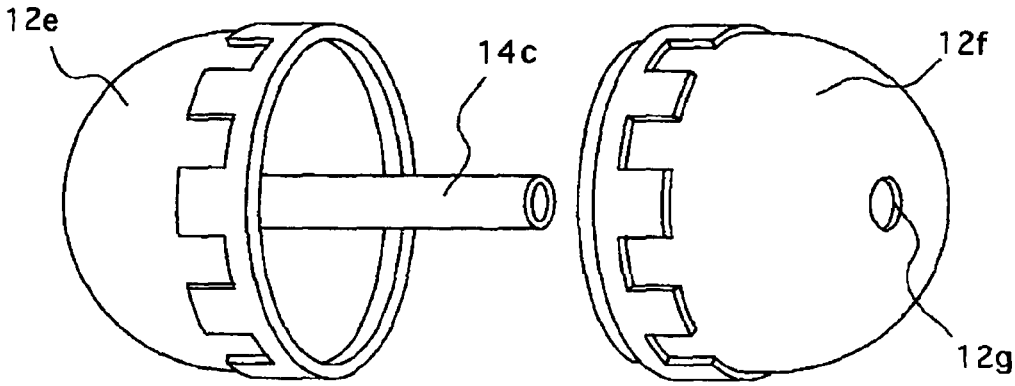
Figure 3C:
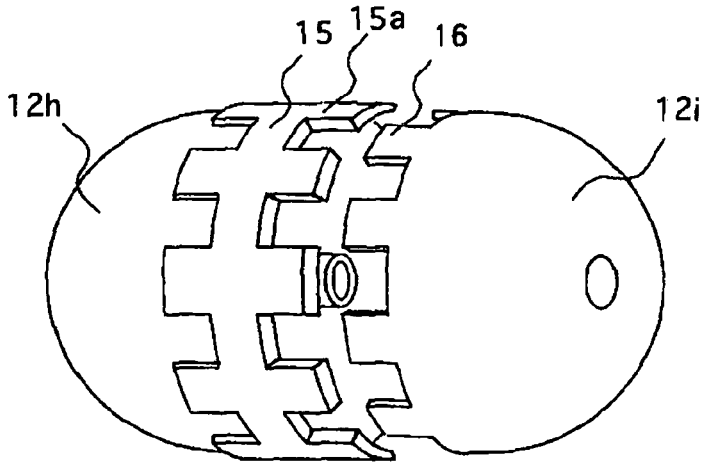

The assembly of the apparatus 1 for removing attachments of the present invention will be explained, referring to FIGS. 3 and 4. FIG. 3 shows variations of assembly of the rotating member 12. As shown in FIG. 3*a*, two parts 12*a*, 12*b* each has a cup-like shape, constituting a rotating member 12. These parts are molded with polyethylene resin, and are fitted together, and/or, welded together to obtain an enveloped structure. In the embodiment shown in FIG. 3*a*, the parts 12*a*, 12*b* have a shape such that the rotating member 12 is substantially divided into two halves; part 12*b* has a fitting collar 12*c* and part 12*a* has a receiver 12*d*, which fit together. As shown in FIG. 3*a*, both the parts 12*a*, 12*b* have a pipe portion 14*a*, which constitutes the breakthrough 14, through which the rope 11 is inserted. In the variation mentioned in FIG. 3, the pipe 14 is formed in part 12*e* only. This makes the assembly of parts 12*e* and 12*f* easier, because no exact centering is required. FIG. 3*c* depicts another variation, where a protruding portion 15 is formed on one of the parts, i.e. part 12*h* in this case. Another part, 12*i* has an end portion 16 with gear like-teeth, which mates with the protruding portion 15. The edges of the protruding portion 15 and the end portion 16 are brought into contact together to assemble the parts 12*e*, 12*f* completely. When the two parts are joined together in the protruding portion 15, which frequently impinges on the structure 2 or on attachments, such as marine organisms on the structure 2, the rotating member 12 may be separated at the joint line. The construction of the variation shown in FIG. 3*c* lessens such a problem, and therefore, the durability of the apparatus 1 is further improved.

The assembly of the rotating member 12 is not only limited to the above examples, other-methods of assembly can be applied when preferable. For instance, the protruding portion 15 may be manufactured separately, then the three parts, i.e. two cup-shaped parts and the protruding portion, are fitted and/or welded together to assemble the rotating member 12. In this case, the two parts of the body of the rotating member 12 are joined together at the center of the rotating member and then the protruding portion 15 is welded to the connected body so as to cover the joint line. In this manner, since the joint line is completely covered with the protruding portion, the problem of the rotating members 12 separating from each other at the joint line after setting out underwater can prevented.

The rotating member 12 may be manufactured by a blow-molding method. That is to say, a cylindrical material (parison) is melted with a heat source and blown into the mold of the rotating member 12 with air. According to the blow-molding method, since the rotating member 12 has no joint, it will not break easily and no water enters into the rotating member, so the durability of the rotating member 12 is improved. Further, it is possible to manufacture the rotating members more simply and at lower cost in comparison to the assembly of a plurality of the body parts by fitting and/or welding them together. In this case, the cylindrical pipe constituting the breakthrough 14 may be prepared separately and fixed to the rotating member's body by means of welding, etc.; or it may also be possible to mold the breakthrough 14 and the rotating member body 12 as a united body.

Figure 4A:
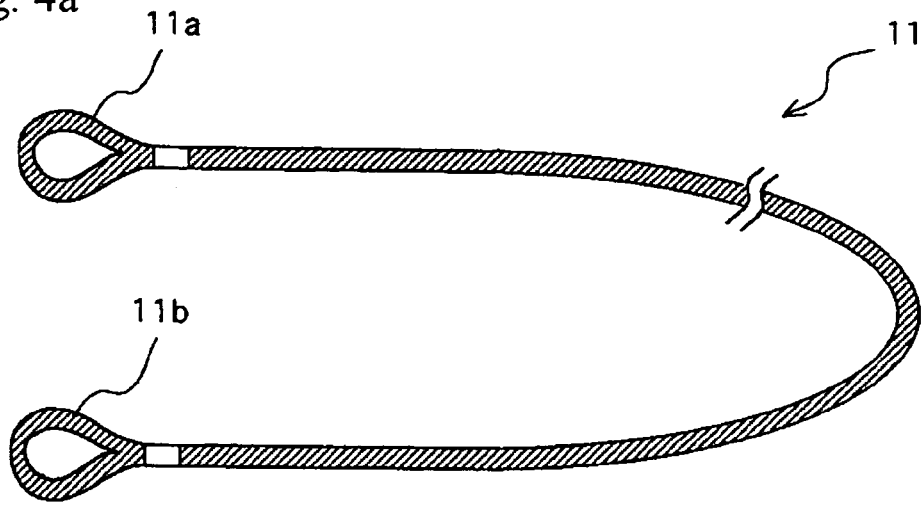
FIGS. 4*a* to 4*c* are schematic views showing a process for assembling the apparatus for removing attachments deposited on underwater structures according to the present invention.

Next, the assembly of the rope 11 and the rotating member 12 will be explained, referring to FIG. 4. As shown in FIG. 4*a*, both ends of the rope 11 have ring portions, 11*a* and 11*b*. The rope 11 may be manufactured by intertwining a synthetic resin, such as polyethylene, which is normally used in the fishing industry. However, the rope material is not limited to polyethylene, other chemical materials, such as nylon or polypropylene, and natural materials, such as cotton, or metal chain made of, for instance, stainless steel, may also be used. However, it is desirable that the metal material only be used for a short term, because of galvanic corrosion. The ring portions 11*a*, 11*b* located at both ends of the rope 11 are formed in such a manner that the top ends of the rope 11 are unraveled, the unraveled portions are then intertwined together with the neck portions of the rings, respectively. It is also acceptable to connect the top ends of the rope 11 to the neck portions by means of fusion bonding.

Figure 4B:
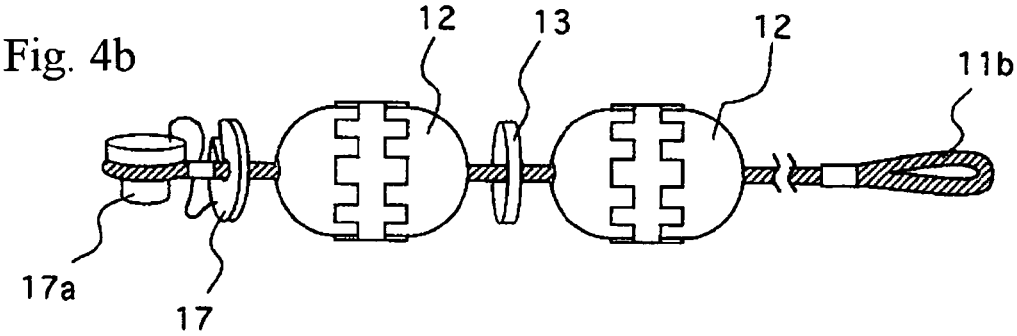

As shown in FIG. 4*b*, a stopper ring 17, which is constituted of a round-shaped plastic plate having a cutout, is provided at one end of the rope 11; the rotating member 12 and the color 13 are then alternatively threaded with the rope 11 from the other end. A plastic pin 17*a* is connected to the stopper ring 17 with the aid of string, and put in the ring portion 11*a* of the rope during the assembly, so that the stopper ring 17 does not fall out from the rope 11. In this manner, since the stopper ring 17 stays at one end of the rope 11, the rotating members 12 or the collars 13 will not drop out from the ring 11. The other ring portion 11*b* is pressed to reduce its volume when threading the breakthrough 14 of the rotating members 12 and the collars 13.

Figure 4C:
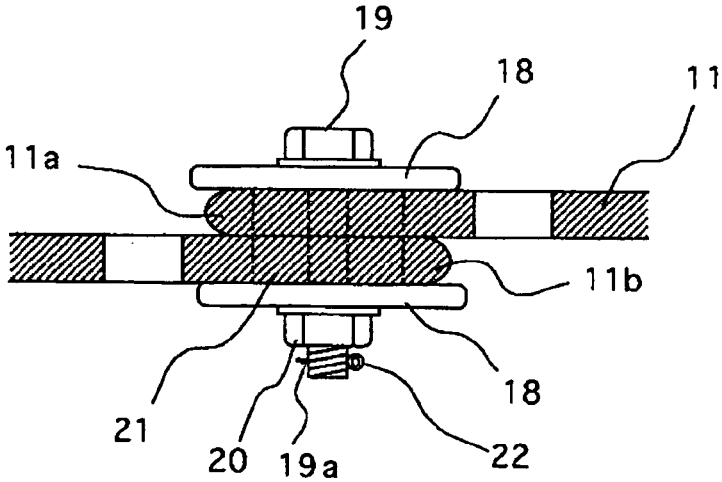

After a suitable number of the rotating members 12 and the collars 13 are threaded with the rope 11, both rings at the ends of the rope 11 are connected together. That is to say, the plastic pin 17*a* is pulled out, the rings 11*a* and 11*b* are superimposed together, the superimposed rings 11*a* and 11*b* are sandwiched by two ring plates 18, 18; and then rings 11*a* and 11*b* and plates 18 are fixed together with the aid of a nut 20 and a bolt 19 as shown in FIG. 4*c*. The ring plates 18, 18 should have a larger diameter than that of the ring portions 11*a* and 11*b* of the rope 11; and a cylindrical member 21 having an inner diameter slightly larger than the diameter of the bolt 19 and an outer diameter slightly smaller than the inner diameter of the rings 11*a* and 11*b* of the rope 11 may be provided between both the ring plates 18 and 18. Or, other members forming a bobbin structure when assembled together can be used instead of the combination of the cylindrical member 21 and the plates 18. It should be noted that a small hole 19*a* is provided at the end of the bolt 19 in a direction perpendicular to the longitudinal direction of the bolt 19. A pin 22 is inserted into the hole 19*a* in order to prevent the bolt-nut connection becoming loose. By connecting both ends of the rope 11 together in such a manner, the connection will not become loose for a long term. After connecting the ends of the rope 11, the stopper ring 17 is removed through the cutout thereof.

The above mentioned connecting method can be applied not only for connecting one rope to make it circular but also a plurality of the ropes 11 to make a bigger circle of ropes, in order to use the apparatus of the invention for a huge structure.

In this manner, the apparatus 1 for removing attachments, such as marine organisms, on underwater structures is provided around underwater structures, such as, steel piles. As shown in FIG. 1, the apparatus 1 is arranged to be a little larger than the outer circumference of the structure 2 and each of the rotating members 12 is buoyant so that the apparatus 1 floats around the structure 2. The rotating members 12 are repeatedly impinged against the surface of the structure 2 by natural forces, such as wind, wave, tide, or tidal difference, so that attachments, such as marine organisms, deposited on the structure are gradually shaved off. In addition, marine organisms, such as shellfish, dislike the sounds and vibration generated when the rotating members impinge against the surface of the structure 2, so that the chance of such marine organisms attaching to the structure 2 will be reduced thereafter. Generally, on structures, such as steel piles extending into the seawater, marine organisms will form a total deposit of about 5 cm in thickness over the period of a year. However, by applying the apparatus of the present invention to piles, which have been set out for several years, the marine organisms deposited on the surface of the piles are removed in two to three weeks; and future attachments of marine organisms can be prevented by leaving the apparatus there as it is.

The rotating members 12 constituting of the apparatus 1 are ellipsoid and central through types, and thus, contact with the structure 1 is concentrated on the center portion of the rotating members 12. However, according to the invention, the protruding portion 15 is provided on the center portion of the rotating members to make this portion thick. The protruding portion 15 will be somewhat worn, but the rotating member 12 itself will not be broken. Further, the protruding portion 15 is molded as a unit body with the rotating member 12 and therefore the amount of wear incurred by the rotating member can be checked by the human eye so that it is easy to know when to change the rotating members 12. Since the protruding portion 15 has a gear-like teeth shape, there are steps in longitudinal and perpendicular directions on the surface of the rotating member, attachments deposited will be efficiently removed not only by contact due to the movement of the rotating member in a rotational direction but also due to the movement of the rotating member in a horizontal direction. Furthermore, since the rotating members are connected together with the aid of a rope, the movement of the rotating members becomes very flexible and free, so that attachments will be efficiently removed in a short period of time.

Furthermore, since the collars 13 are provided between the rotating members 12 and then impinge upon the curved portions on both longitudinal ends of the rotating members 12, the depositing of marine organisms on the curved portions can be prevented in a suitable manner. The collars 13 also work as a damper to prevent the collision of the rotating members 12 with each other and thus damage to the rotating members due to such collisions. In addition, since the apparatus according to the invention can be assembled by threading the rotating members 12 and the collars 13 through the breakthrough 14 and connecting the ends of the rope 11 as explained above, the apparatus can be provided around the structure 2 very easily and is less costly in comparison to the conventional apparatuses. It should be noted that the setting up of the apparatus underwater can be completed in a short time by previously assembling the rotating members 12 and collars 13 to the rope 11 on the ground with the stopper rings 17 to be placed in the rings at both ends of the rope 11 to prevent the rotating members or collars from falling out, and then carrying the pre-assembled apparatus to the site where the apparatus is to be provided.

In the above-mentioned embodiment, the rotating members 12 have an ellipsoid shape, however, spherical or rugby ball shaped rotating members could also be used if preferred. Particularly, by using rugby ball shaped rotating members, attachments deposited on the edges of piles having a rectangular shape can be efficiently removed. The construction of the rotating members 12 is not limited to a hollow shape, as is applied here, but rather any type of rotating members can be used as long as they have a buoyancy sufficient for floating the rotating members on the surface of water. In practice, a rotating member is desired such that the center of the rotating members 12 is located at surface water level when the apparatus 1 is set out. It is possible for the rotating member to be partially hollow, or to enclose water or sand in the hollow of the rotating members so as to adjust the buoyancy thereof. In this case, it is possible to provide an opening with a closing cap in the area where the removal of attachments is not disturbed, such as at the curved area between the protruding portion 15 and one of the longitudinal ends of the ellipsoid rotating member, so that water or sand can be inserted into the rotating member as occasion demands. Further, it is also possible to adapt a solid structure for the rotating members 12 by making them of floating type plastic materials (including foam plastics).

Figure 5:
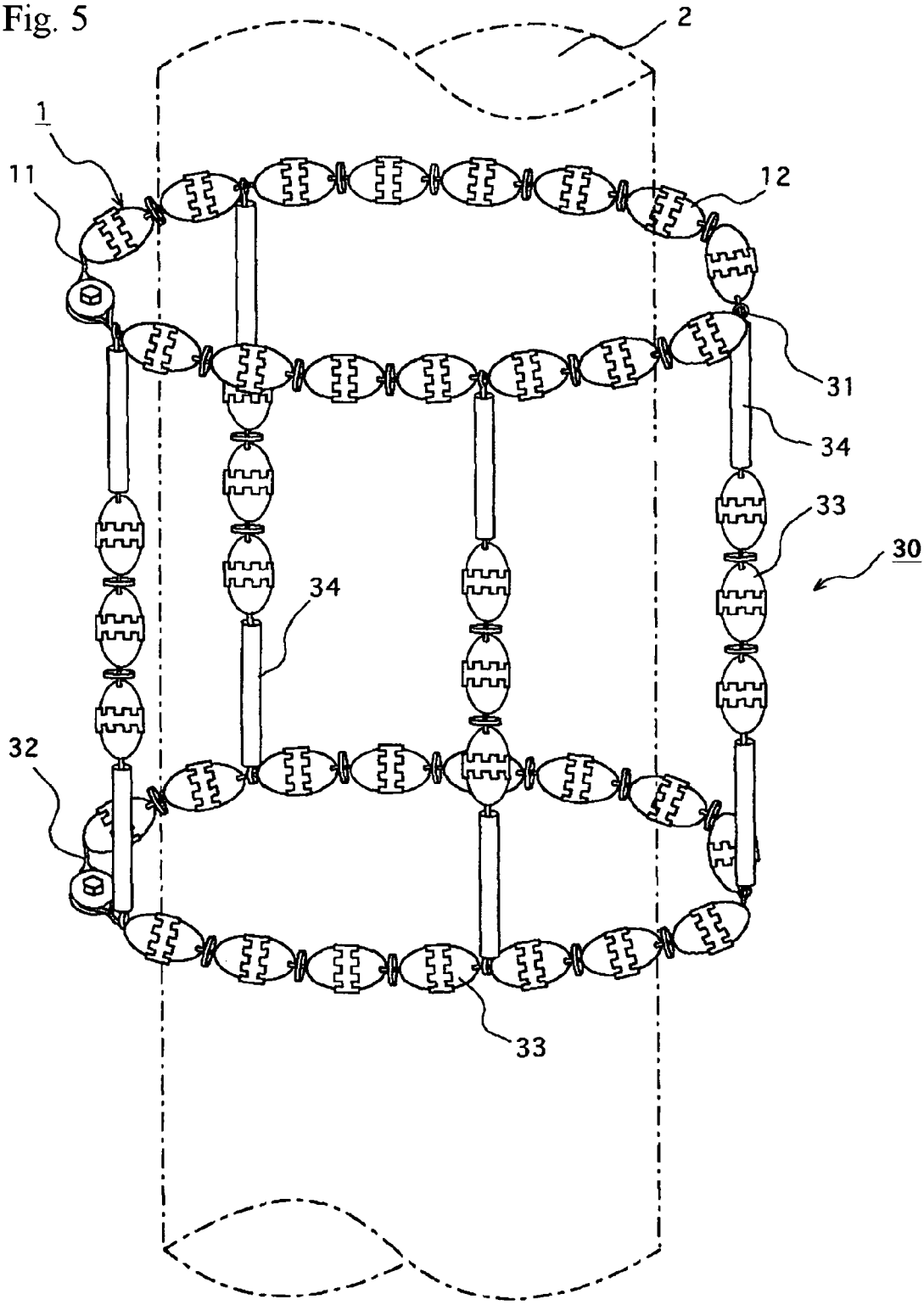
FIG. 5 is a perspective view illustrating another embodiment of the apparatus for removing attachments deposited on underwater structures according to the present invention.

FIG. 5 shows the construction of the second embodiment of the apparatus for removing attachments according to the present invention. As shown in FIG. 5, the apparatus 30 showing the construction of the second embodiment, comprises the apparatus 1, which has the same construction of the first embodiment, a plurality of second ropes 31 being connected to the apparatus 1 being extended in a vertical direction; a third rope 32 being connected to the lower end of each of the second ropes 31 so as to extend substantially parallel to the first rope 11, and a plurality of second rotating members 33 being threaded with the second and third ropes 31 and 32, respectively. Although the surface of water is not illustrated in FIG. 5, the apparatus is set out such that the first apparatus 1 floats on the surface level of the water, and the others, i.e. the second and third ropes and the second rotating members threaded with these ropes, waft underwater. According to the second embodiment, the apparatus 30 as a whole is set out around the surface of structures, such as steel piles extending underwater, to remove not only attachments deposited around the water surface level but also attachments on the structure located up to several meters underwater; and to prevent attachments of marine organisms thereafter.

Both the upper and lower ends of the second ropes 31 are arranged to be rings, respectively. The first rope 11 passes through the upper ring ends of the second ropes 31 and the third rope 32 goes through the lower ring ends of the second ropes 31, respectively, to connect them together. At the upper and lower ends of the second ropes 31, the suction pipes 34 are arranged, and between the suction pipes 34, three of the second rotating members 33 are provided. Between the abutted rotating members 33, the collars 13 are provided in order to prevent the collision of the rotating members 33 with each other and also to prevent marine organisms from attaching to the curved ends of the second rotating members 33. The second rotating member 33 has the same construction as that of the first rotating members 12 explained above, except that the buoyancy of the second rotating members 33 is adjusted so as to make the second rotating members 33 waft underwater and impinge against the surface of the structure 2 with a natural force. That is to say, the second rotating members 33 have a heavier weight than the first rotating member 12 to prevent them from rising to the water surface. The heavier weight of the second rotating members 33 can be obtained by making the hollow portion of the second rotating members 33 smaller than that of the first rotating members 12, by making the second rotating members 33 solid, or by adjusting the buoyancy of the rotating members 33 with the amount of water or sand to be enclosed in the rotating members 33. Such an arrangement can also be constituted that an opening is provided in the curved portion of the rotating members 33, for example, between the protruding portion 15 and the top end of the breakthrough 14, with a closing cap, and water, sand or gravel put inside the rotating members 33 through the opening to adjust the buoyancy. Furthermore, it is also possible to make at least two or more breakthroughs on the surface of the rotating members 33, through which water instead of air can flow into the hollow. Other construction features of the second rotating members 33, for instance, the center breakthrough pipe 14 and the design of the protruding portions 15, are substantially the same as that of the first rotating member 12, which is explained above.

The third rope 32 surrounds the structure 2 underwater. It's construction is substantially the same as the apparatus 1 except that the second rotating members 33 are provided around the rope 32. The third rope 32 wafts underwater and therefore the second rotating members 33 on the third rope 32 are arranged so as not to rise to the water surface. According to this construction, the rotating members 33 repeatedly impinge against the surface of the structure 2 so as to effectively remove marine organisms attached on the underwater surface of structure 2. Further, by leaving the apparatus 30 around the structure 2, the continued attachment of marine organisms on the underwater surface of the structure 2 can be prevented. When the apparatus 1, which is floating on the surface of water, is moved by the force of wind or waves, the movement of the apparatus 1 is relayed to the third rope 32 via the second rope 31, and thus the second rotating members 33 on the third rope 32 impinge against the surface of the structure 2 and remove marine organisms deposited on the underwater part of the structures 2 effectively. Particularly, due to the existence of the suction pipes 34, the movement of the first rope 11 at the surface level of the water is directly relayed to the second rope 31 and then the third rope 32, so that the second rotating members 33 on the second and the third ropes 31 and 32 move underwater in various directions to remove attachments effectively. Further, it can be expected that the suction pipes 34 themselves impinge upon the surface of the structure 2, removing the attachments thereon.

In the second embodiment in FIG. 5, there are shown four of the second ropes 31 extending in a vertical direction. However, at least one or more ropes may be provided. In FIG. 5, a two stage construction (the first rope 11 and the third rope 32) is shown, however, three or more stage constructions may be provided. Through study it has been found that most of the attachments are deposited on the structure 2 at a depth of 2 or 3 meters from the surface of the water, however, there are still some attachments, such as marine organisms found at up to 12 to 13 meters from the surface. Therefore, according to the variations of the second embodiment, where plural stages of ropes (and rotating members) can be successively connected, it is possible to extend the apparatus to 12 or 13 meters in depth from the water surface.

In another variation of the apparatus as shown in FIG. 5, it is possible to suspend the second rope 31 without the third rope 32. In this case, a stopper should be attached at the lower end of the second rope 32 in order to prevent the rotating members 33, the suction pipes 34 and the collars 13 from falling off. According to this variation, the second rope 31 with the rotating members 33 and the suction pipes 34 can more freely waft underwater and thus attachments, such as marine organisms, can be removed more effectively.

Contrary to this, it is possible to arrange an apparatus without any first rope. That is to say, the third rope 32 is connected to the structure 2 with a fastening means, such that the third rope 32 to be kept and waft underwater thereof, and the second rope 31 is connected to the third ropes 32 in an upper direction such that they may also be able to waft underwater. In this case, by attaching the first rotating members 12 which have suitable buoyancy to the second ropes, or on both of the second and third ropes, the second ropes 31 can be allowed to rise and freely waft in an upward direction.

In the above mentioned embodiments, the explanation has been based on the use of a steel pile extending in a perpendicular direction. However, the present invention is not limited to such a pile, but can be applied to perpendicular piles, vertical piles, any types of supporting stanchions, protection covers, heavy corrosion-resistant painted surfaces, or the like, so as to remove the attachments thereon without damaging such objects and preventing the attachments from being deposited thereafter. In case that the apparatus for removing attachments according to the invention is applied to the horizontally extending underwater piles, a plurality of single stage apparatuses each constituted of a third rope 32 and the second rotating members 33 (with collars) are provided around the piles without being connected to each other, or a plural staged apparatus where a plurality of apparatuses constituted of the third rope 32 and the second rotating members 33 that are connected together by the second rope 31 and the second rotating members 32 (with suction pipes and collars) can be used.

In the apparatus for removing attachments according to the invention, a plurality of rotating members threaded with a rope made of polyethylene or the like, so as to make it float and/or waft with the aid of a natural forces are used. Such an apparatus is provided around the outer circumference of the structure, the floating or wafting rotating members repeatedly impinge upon the surface of the structure to remove the attachments thereon and prevent marine organisms from being deposited on the structure thereafter. This apparatus can be applied to, for example, vertical piles, perpendicular piles, horizontal piles, protection covers, or heavy corrosion-resistant surfaces of underwater structures, in order to remove attachments deposited on the surface of the structures.

What is claimed is:

1. An apparatus for removing attachments deposited on a surface of an underwater structure and/or preventing that such attachments be deposited thereafter, wherein the apparatus is floated with a natural force and repeatedly impinges upon the surface of the structure to remove the attachments deposited thereon; comprising:

a first rope being provided around the surface of the structure; and at least one or more rotating members threading with said first rope and being freely rotatable about said rope;

a second rope being connected to said first rope extending in a direction substantially perpendicular to the extending direction of said first rope; and at least one or more rotating members threading with said second rope and being freely rotated about said second rope; wherein a heavy material is enclosed in the second rotating member; and/or said second rotating members have at least one opening through which water can pass through the inside of the second rotating members.

2. An apparatus according to claim 1, wherein at least a part of said rotating member is hollow.

3. An apparatus according to claim 1, wherein the heavy material is sand or water.

4. An apparatus according to claim 1 further comprises:

a third rope being connected one of the ends of said second ropes and being arranged to be substantially parallel to said first rope;

and at least one of said second rotating members threaded with said third rope.

5. An apparatus according to claim 1, wherein at least two or more of the rotating members are attached to the ropes and cylindrical collars are provided between abutted rotating members, respectively; and each said cylindrical collars has an inner diameter sufficiently large than the diameter of the relevant rope and an outer diameter smaller than the diameter of the rotating members adjacent to the collar.

6. An apparatus according to claim 1, wherein said rotating member has an ellipsoid shape or a rugby ball shape and a breakthrough extending in its longitudinal direction, through which said rope is inserted.

7. An apparatus according to claim 1, wherein a protruding portion is provided on at least one part of the surface area of said rotating member.

8. An apparatus according to claim 1, wherein said protruding portion comprises a plurality of ridges evenly spaced thereon and extending in a direction perpendicular to the rotational direction of the rotating member.

9. An apparatus according to claim 1, wherein said rotating member are manufactured by blow-molding of polyethylene resin.

10. An apparatus according to claim 1, wherein said rotating member is constituted of two or three parts, which are manufactured by molding polyethylene resin; and said rotating member is assembled by fitting or welding the parts together.

11. An apparatus according to claim 1, wherein said ropes are made by intertwining fibers made of synthetic resin.

12. An apparatus according to claim 1, wherein both ends of said first and/or the third rope are arranged to form a ring shape; and these ring-shaped ends are superimposed and connected together with the aid of a bobbin shaped fastening means.

13. An apparatus according to claim 11, wherein the synthetic resin is polypropylene.

* * * * *